US010292459B2

(12) United States Patent
Lau

(10) Patent No.: US 10,292,459 B2
(45) Date of Patent: May 21, 2019

(54) FASTENER

(71) Applicant: Cutter Technologies Pte Ltd, Singapore (SG)

(72) Inventor: Choon Meng Lau, Singapore (SG)

(73) Assignee: Cutter Technologies Pte Ltd, Singapore (SG)

( * ) Notice: Subject to any disclaimer, the term of this patent is extended or adjusted under 35 U.S.C. 154(b) by 330 days.

(21) Appl. No.: 15/376,614

(22) PCT Filed: Sep. 15, 2016

(86) PCT No.: PCT/SG2016/050447
§ 371 (c)(1),
(2) Date: Dec. 12, 2016

(87) PCT Pub. No.: WO2018/052368
PCT Pub. Date: Mar. 22, 2018

(65) Prior Publication Data

US 2018/0220750 A1 Aug. 9, 2018

(51) Int. Cl.

| | |
|---|---|
| ***A44B 11/25*** | (2006.01) |
| ***A44B 13/02*** | (2006.01) |
| ***A45C 13/14*** | (2006.01) |
| ***A44B 13/00*** | (2006.01) |
| *A45F 5/02* | (2006.01) |

(52) U.S. Cl.
CPC ..... *A44B 13/02* (2013.01); *A44B 13/0058* (2013.01); *A45C 13/14* (2013.01); *A45F 5/021* (2013.01)

(58) Field of Classification Search
CPC ..... A44B 13/02; A44B 13/0058; A44B 11/25; A44B 11/2523; A45C 13/14
USPC ..... 24/593.1
See application file for complete search history.

(56) References Cited

U.S. PATENT DOCUMENTS 2,904,866 A 9/1957 Carter
3,722,909 A 3/1973 Esner
(Continued)

FOREIGN PATENT DOCUMENTS

DE 20019252 U1 4/2001

OTHER PUBLICATIONS

Foreign Communication from a Related Counterpart Application, International Search Report and Written Opinion dated Oct. 31, 2016, International Application No. PCT/SG2015/050447 filed on Sep. 16, 2016.

*Primary Examiner* — Jason W San

(57) ABSTRACT

A fastener for detachably securing a first item to a second item comprises a connector comprising a U-shaped rod having a central portion between two legs and a main body configured to be attached to the second item. The main body comprises a housing having a slot configured to allow passage of a central portion therethrough into the housing, and a downwardly biased securing pin provided within the housing. The slot has an upstanding lip provided at a lower edge of the slot that defines two downwardly extending openings. Each of the openings are configured to allow the two legs to extend out of the housing when the central portion is in a secured position where the central portion is lowered in the housing relative to the slot. The securing pin is configured to exert a downward bias against the central portion in the secured position.

7 Claims, 8 Drawing Sheets

(56) References Cited

U.S. PATENT DOCUMENTS

| | | | | | |
|---|---|---|---|---|---|
| 5,067,211 | A * | 11/1991 | van Riesen | A44B 11/2523 | 24/633 |
| 5,584,108 | A * | 12/1996 | Pleyer | A44B 11/2523 | 24/637 |
| 5,850,996 | A * | 12/1998 | Liang | A45F 5/02 | 248/221.11 |
| 8,919,622 | B1 * | 12/2014 | Gabriel | A45F 5/02 | 224/148.4 |
| 2010/0281660 | A1 * | 11/2010 | Lee | A44B 11/2523 | 24/593.1 |
| 2010/0314930 | A1 * | 12/2010 | Akaike | A44B 11/2523 | 297/468 |
| 2015/0166005 | A1 * | 6/2015 | You | A44B 11/2523 | 24/642 |
| 2015/0296927 | A1 * | 10/2015 | Ha | A44B 11/2515 | 24/593.1 |
| 2015/0320148 | A1 * | 11/2015 | Bevilacqua | A44B 11/2592 | 24/634 |
| 2015/0321639 | A1 * | 11/2015 | Horsefall | B60R 22/18 | 24/599.3 |

* cited by examiner

FASTENER

CROSS-REFERENCE TO RELATED APPLICATIONS

The present application is a filing under 35 U.S.C. 371 as the National Stage of International Application No. PCT/SG2016/050447, filed Sep. 15, 2016, entitled "FASTENER," which is incorporated herein by reference in its entirety for all purposes.

FIELD

This invention relates to a fastener for detachably securing a first item to a second item.

BACKGROUND

In many day-to-day applications, it is desirable to secure and detach a first item to and from a second item, such as a water bottle to a bag, a pouch to a belt, an accessory to a backpack and so on. However, many existing fasteners are complicated or cumbersome to use. For example, some existing fasteners may require a few steps to secure or detach, or may require two hands to easily operate. Furthermore, some existing fasteners may allow accidental detachment of the two items.

SUMMARY

According to a first aspect, there is provided a fastener for detachably securing a first item to a second item, the fastener comprising: a connector comprising a U-shaped rod having a central portion between two legs, the connector configured to be attached to the first item; and a main body configured to be attached to the second item, the main body comprising a housing having a slot configured to allow passage of the central portion therethrough into the housing, the slot having an upstanding lip provided at a lower edge of the slot, the upstanding lip defining two downwardly extending openings, each of the two downwardly extending openings at each end of the slot and configured to allow each of the two legs to extend out of the housing when the central portion is in a secured position where the central portion is lowered in the housing relative to the slot and engages an inner surface of the upstanding lip; and a downwardly biased securing pin provided within the housing, the securing pin exerting a downward bias against the central portion in the secured position.

The fastener may further comprise a vertically translatable lock cage provided in the housing, a portion of the securing pin positioned within the lock cage, the lock cage transmitting the downward bias against the portion of the securing pin, and a lock bar provided in the housing above the lock cage, the lock bar translatable between an unlocked position and a locked position, in the unlocked position the lock bar allowing upward translation of the lock cage thereby allowing upward movement of the securing pin, and in the locked position the lock bar obstructing and preventing upward translation of the lock cage thereby preventing upward movement of the securing pin.

The lock bar may be provided adjacent the lock cage, at least one stub may be provided on one of the lock cage and the lock bar, and at least one cut-out may be provided on the other of the lock cage and the lock bar, the at least one cut-out able to accommodate the at least one stub therein, wherein in the unlocked position, the at least one stub is vertically aligned with the at least one cut-out to allow relative movement of the at least one stub into the at least one cut-out to allow upward translation of the lock cage, and wherein in the locked position, the at least one stub and the at least one cut-out are not vertically aligned.

The fastener may further comprise a lock positioner configured to engage the lock bar in the unlocked position and in the locked position, wherein a bump is provided on one of the lock positioner and the lock bar, and wherein two spaced-apart indentations are provided on the other of the lock positioner and the lock bar, the bump received in one of the two indentations in the unlocked position and the bump received in the other of the two indentations in the unlocked position.

The securing pin may comprise a cylindrical rod free to rotate about its central longitudinal axis.

The central portion of the U-shaped rod may comprise a cylindrical rod.

The downward bias may be provided by an extension spring provided in the housing.

BRIEF DESCRIPTION OF FIGURES

In order that the invention may be fully understood and readily put into practical effect there shall now be described by way of non-limitative example only exemplary embodiments of the present invention, the description being with reference to the accompanying illustrative drawings.

FIG. 1(*b*) is the fastener of FIG. 1(*a*) with the connector secured to the main body.

FIG. 1(*c*) is a back isometric view of the main body of FIG. 1(*a*).

FIG. 4(*b*) shows cross-sectional side and back views of the fastener of FIG. 1(*a*) with the central portion of the connector in a release or inserted position.

FIG. 4(*c*) shows orthogonal cross-sectional side and back views of the main body of the fastener of FIG. 1(*a*) in a disengaged position without the connector.

FIG. 6(*b*) shows front and back isometric views of the first exemplary embodiment of the fastener in a locked position.

DETAILED DESCRIPTION

Figure 1A:
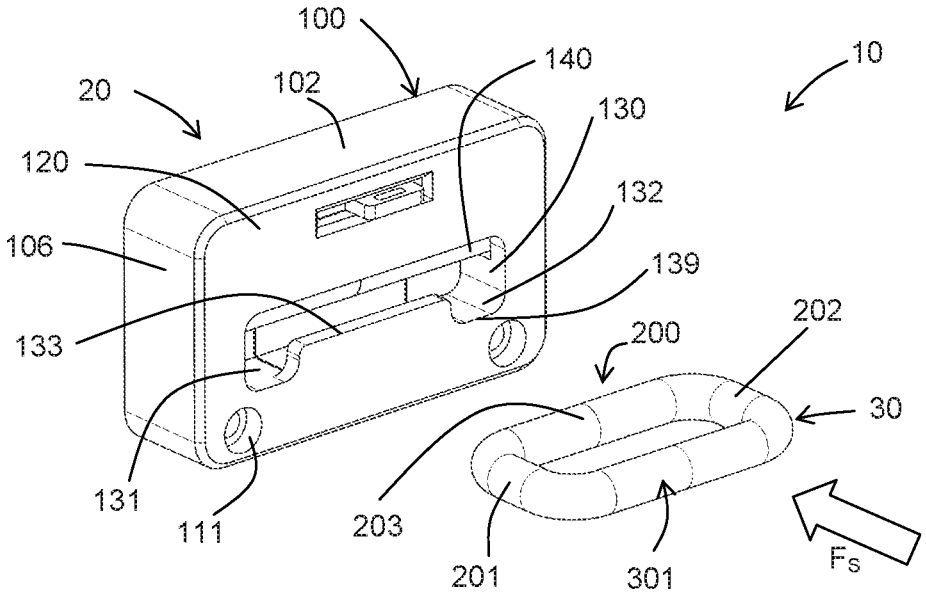
FIG. 1(*a*) is a front isometric view of a first exemplary embodiment of the fastener with the connector detached from the main body.

Exemplary embodiments of the fastener 10 will be described below with reference to FIGS. 1(*a*) to 11. The same reference numerals are used throughout the figures to denote the same or similar parts among the various embodiments.

Figure 1B:
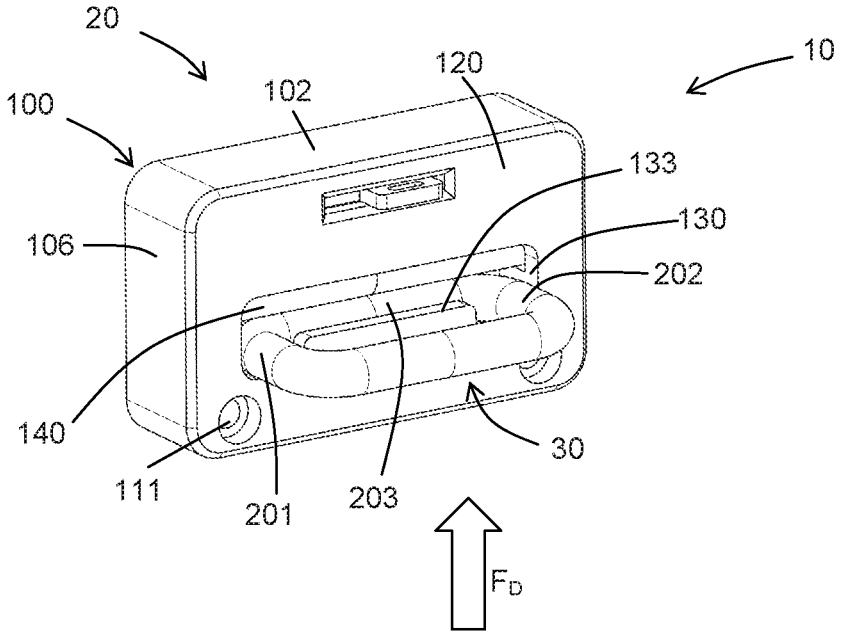
Figure 1C:
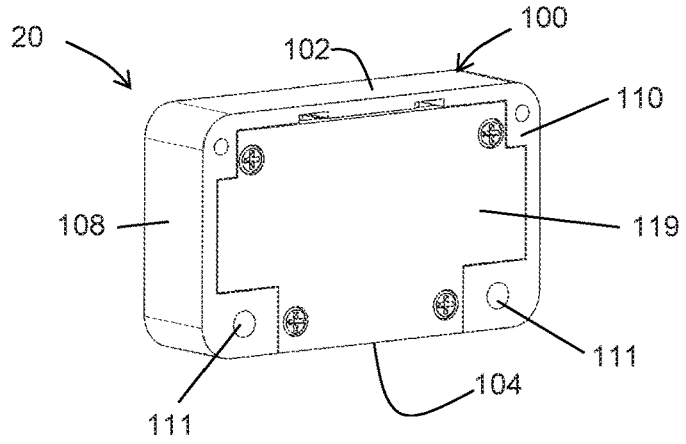

In general, as shown in FIGS. 1(*a*) to (*c*), the fastener 10 comprises a main body 20 and a connector 30. The connector 30 is configured to be attached to a first item (not shown) and the main body 20 is configured to be attached to a second item (not shown). The first item may be any item such as a water bottle, a bag, a container, and so on, that one may desire to detachably secure to the second item. The second item may be any item such as a bag, a belt, a wall, a side of a table, a back of a chair, an interior wall of a car and so on. The main body 20 comprises a housing 100 and the connector 30 comprises a U-shaped rod 200.

It should be noted that in the following description, references to up, down, upper, lower, raised, lowered, upward, downward, horizontal, vertical, left, right, front, back and so on are with respect to the housing 100 having what will nominally be referred to as a top wall 102, a bottom wall 104, a left wall 106 a right wall 108, a back wall 110, and a front wall 120. In use, it is envisaged that the housing 100 may be oriented in any desired direction such that what is referred to as its top wall 102 may in fact be facing the ground or any other direction.

In use, when the main body 20 is attached to the second item, the back wall 110 of the housing 100 is against the second item. Through holes 111 are preferably provided in the housing 100 for attaching the main body 20 to the second item with known securing means such as screws or rivets or pliable ties.

The U-shaped rod 200 of the connector 30 is preferably in the form of a square U-shape having a central portion 203 between two legs 201, 202, wherein at least a portion of the two legs 201, 202 adjacent the central portion 203 are parallel to each other and orthogonal to the central portion 203. The U-shaped rod 200 preferably has a circular cross-section, although other cross-sectional shapes may also be used. Preferably, at least the central portion 203 of the U-shaped rod comprises a cylindrical rod.

Figure 2:
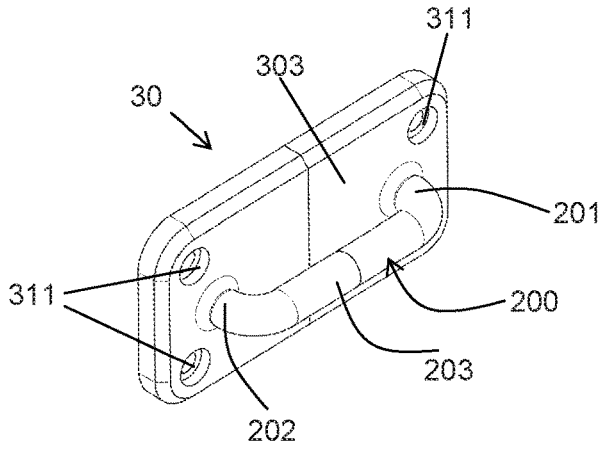
FIG. 2 is a front perspective view of an alternative embodiment of the connector.

The connector 30 may have any desired form while including the U-shaped rod 200. For example, as shown in FIGS. 1*a*) and (*b*), the connector 30 may comprise a ring 301 that the U-shaped rod 200 is an integral part of, or, as shown in FIG. 2, the connector 30 may include a plate 303 to which the legs 201, 202 of the U-shaped rod 200 are attached. The plate 303 may be provided with through holes 311 for attaching the connector 30 to the first item.

As shown in FIGS. 1(*a*), 1(*b*), the front wall 120 of the housing 100 is provided with a slot 130 configured to allow the central portion 203 of the U-shaped rod 200 of the connector 30 to be inserted into the housing 100 through the slot 130. Preferably, the slot 130 is horizontally provided in the front wall 120 of the housing 100. The slot 130 is provided with an upstanding lip 133 on a lower edge 139 of the slot 130. The horizontal length of the upstanding lip 133 is less than the length of the lower edge 139 of the slot 130 and the upstanding lip 133 is preferably generally centrally provided on the lower edge 139 of the slot 130, thereby defining two downwardly extending openings 131, 132, one 131, 132 at each end of the slot 130, on each side of the centrally provided upstanding lip 133. Preferably, the upstanding lip 133 is flush with an external surface of the front wall 120 of the housing 100.

Figure 3:
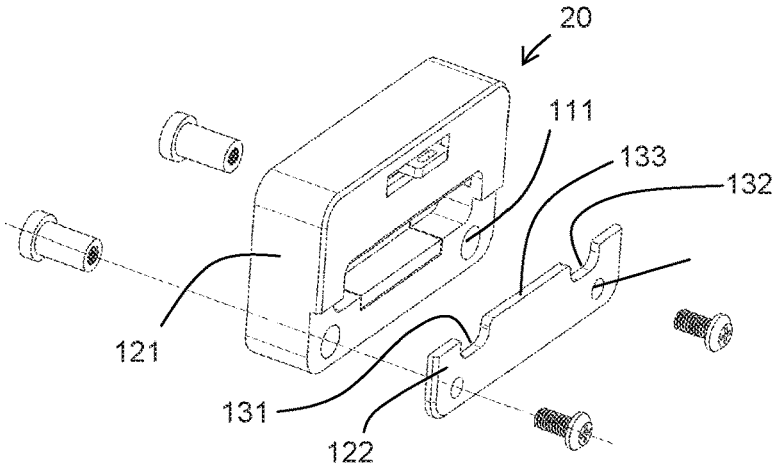
FIG. 3 is a exploded assembly view of an alternative embodiment of a front wall of the main body.

In some embodiments, as shown in FIGS. 1(*a*), 1(*b*), the upstanding lip 133 may be integral with the front wall 120 of the housing 100 when the front wall 120 is of a single piece construction. Alternatively, as shown in FIG. 3, the front wall 120 may have a two-piece construction 121, 122 in which at least the upstanding lip 133 is provided on a lower piece 122 of the front wall 120. The downwardly extending openings 131, 132 may also be defined by the lower piece 122 as shown in FIG. 3. A two-piece construction 121, 122 may be used if it is desirable to have a smaller form factor for the housing 100 and the connector 30, in which case the lower piece 122 may be made of metal while the other parts of the fastener 10 may be made of plastic in order for a smaller or thinner upstanding lip 133 to be able to engage and retain the central portion 203 within the housing 100 without breaking under use. The lower piece 122 and upper piece 121 may be assembled together by known means such as screws and nuts, and their 121, 122 assembly may preferably utilize the same through holes 111 provided for attaching the housing 100 to the second item to reduce total number of parts in the fastener 10. Appreciably, all or at least part 121 of the front wall 120 may be integral with other parts of the housing 100.

The main body 20 is configured to allow the central portion 203 of the connector 30 to be lowered within the housing 100 relative to the slot 130 into a secured position, as shown in FIGS. 1(*b*) and 4(*a*). In the secured position, an inner surface of the upstanding lip 133 engages and retains the central portion 203 within the housing 100, while the legs 201, 202 extend out of the front wall 120 of the housing 100 through the downwardly extending openings 131, 132 of the slot 130 respectively. In this way, when the central portion 203 is in the secured position, the connector 30 cannot be removed from the main body 20.

Figure 4A:
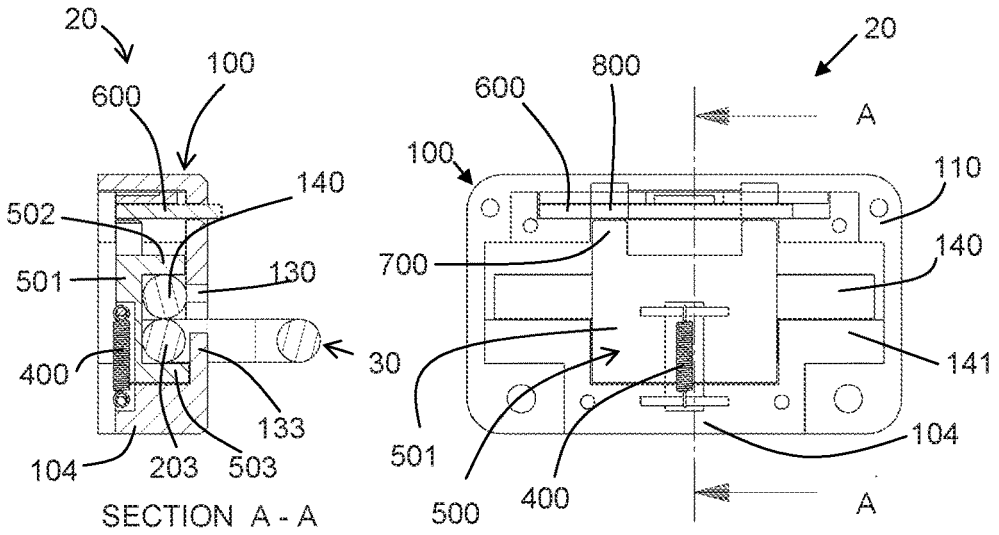
FIG. 4(*a*) shows cross-sectional side and back views of the fastener of FIG. 1(*a*) with the central portion of the connector in a secured position.
Figure 4B:
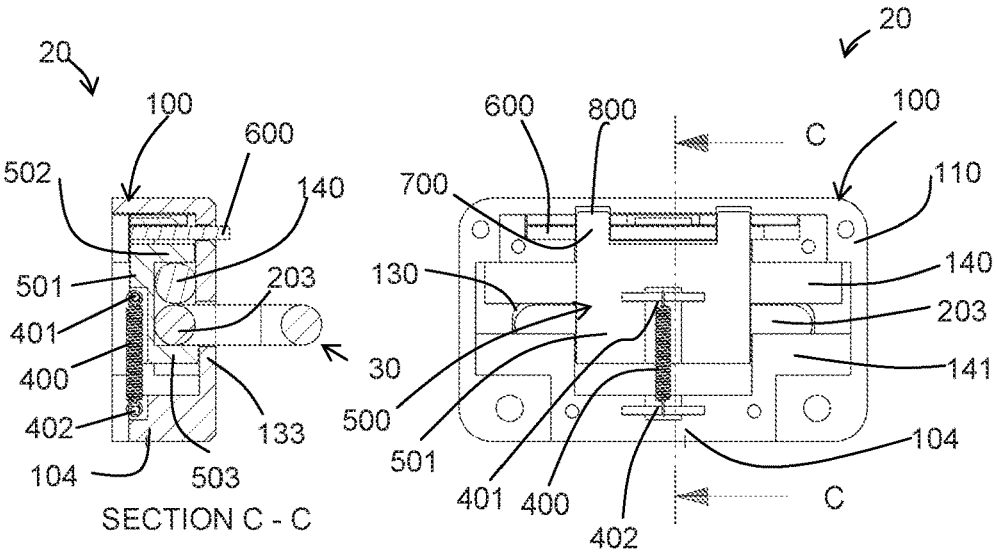
Figure 4C:
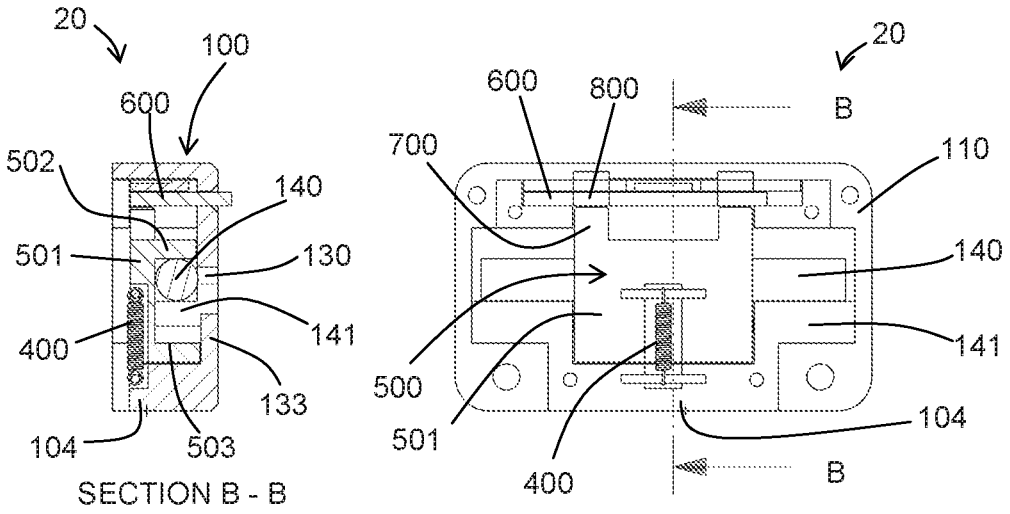

The connector 30 may be detached from the main body 20 only when the central portion 203 is in a release position as shown in FIG. 4(*b*), in which the central portion 203 is raised relative to the slot 130 such that the upstanding lip 133 no longer engages the central portion 203, thereby allowing the central portion 203 to exit the housing 100 through the slot 130. To prevent detachment of the connector 30 from the main body 20, that is, to keep the central portion 203 in the secured position within the housing 100, the main body 20 includes a securing pin 140 having a cylindrical shape that is provided within the housing 100, parallel to the slot 130. A downward bias is permanently applied to the securing pin 140, as will be described in greater detail below.

When the securing pin 140 is in a disengaged position at rest prior to insertion of the connector 30 into the main body 20, the securing pin 140 is at its lowest possible position relative to the housing 100. In the disengaged position of the securing pin 140, a lower portion of the securing pin 140 obstructs an upper portion of the slot 130, as can be seen in FIGS. 1(*a*) and 4(*c*). The securing pin 140 has a circular cross-section and is free to rotate about its central longitudinal axis that is horizontally oriented within the housing 100. The securing pin 140 is configured to move up and down within the housing 100 under action of externally applied forces and the downward bias respectively, as will be described in greater detail below.

When the central portion 203 of the U-shaped bar 200 is forcefully inserted by a user into the main body 20 through the slot 130, the central portion 203 comes into contact with and applies a securing force (as indicated by arrow $F_S$ shown in FIG. 1(*a*)) to the lower portion of the securing pin 140 that obstructs the upper portion of the slot 130. Although the securing force is mainly directed inwardly into the housing 100, that is, from the front wall 120 towards the back wall 110 of the housing 100, because of the circular cross-section of the securing pin 140, the securing force also has an upward force component that, when great enough to overcome the permanently applied downward bias on the securing pin 140, raises the securing pin 140 within the housing 100. Raising the securing pin 140 removes the partial obstruction of the slot 130 and allows the central portion 203 to be inserted into the housing 100, as can be seen in FIG. 4(*b*) when the central portion 203 is in an inserted position.

When the central portion 203 is in the inserted position and the user stops applying the securing force, the downward bias that is permanently applied to the securing pin 140 pushes the securing pin 140 downwardly against the central portion 203, thereby moving the central portion 203 into the secured position and keeping the central portion 203 in the secured position, as shown in FIG. 4(*a*).

To detach the connector 30 from the main body 20, as mentioned above, the central portion 203 must be raised from the secured position to the release position in which the central portion 203 is clear of the upstanding lip 133. Notably, the release position is the same as the inserted position of the central portion 203 (FIG. 4(*b*)), in which the central portion 203 is in the housing 100 but clear of the upstanding lip 133.

To raise the central portion 203 from the secured position to the release position, an externally applied detaching force must be applied by the user to any part of the connector 30 that remains outside the main body 20, in a generally upward direction (as indicated by arrow $F_D$). An upward component of the detaching force must be greater than the permanently applied downward bias acting on the securing pin 140 in order for the central portion 203 to be raised past the upstanding lip 133 against the downwardly biased securing pin 140. Because of the circular cross-section of the securing pin 140, the generally upwardly applied detaching force also has a lateral force component that acts against the central portion 203 as a result of its contact with the cylindrical securing pin 140, in a direction out of the housing 100, that is, from the back wall 110 towards the front wall 120 of the housing 100. The lateral force component pushes the central portion 203 of the connector 30 out of the housing 100 through the slot 130 once the central portion 203 has sufficiently cleared the upstanding lip 133 under action of the detaching force.

Appreciably, the release or inserted position of the central portion 203 is a transitory position that is generally not a stable position because, either the permanently applied downward bias acting on the securing pin 140 tends to push the central portion 203 into the secured position when the connector 30 is being inserted into the housing 100, or the detaching force raising the central portion 203 at the time of removing the connector 30 from the housing 100 has the lateral component that tends to push the central portion 203 out of the main body 20.

As the securing pin 140 is free to rotate within the housing 100, the connector 30 may be smoothly inserted into and removed from the main body 20 by application of the securing and detaching force to the connector 30 against the securing pin 140. In this way, the fastener 10 is easy to use as the user may secure the connector 30 to the main body 20 with a simple one-handed, one-touch motion, i.e., the user only pushes the connector 30 into the main body 20 and the downwardly biased securing pin 140 will automatically push the connector 30 down into the secured position. Removal of the connector 30 from the main body 20 is another one-touch motion, i.e., the user only pushes the connector 30 upwards against the securing pin 140 and the connector 30 automatically pops out of the slot 130 once the central portion 203 of the connector 30 clears the retaining lip 133 of the slot 130.

The permanently applied downward bias may be provided by means of at least one extension spring 400 included in the main body 20 and provided in the housing 100, as shown in FIGS. 4(*a*) to 4(*c*) (a back plate 119 forming at least part of the back wall 110 of the housing 100 is hidden from view in these figures, for clarity of the internal components). The extension spring 400 is provided between the securing pin 140 and the back wall 110 of the housing 100. The extension spring 400 has a first end 401 in functional connection with the securing pin 140 and a second end 402 connected to the housing 100 below the first end 401. For example, as can be seen in FIGS. 4(*a*) to 4(*c*), the first end 401 of the extension spring 400 may be attached to a vertically translatable lock cage 500 included in the main body 20 and provided within the housing 100, with a portion of the securing pin 140 positioned within the lock cage 500. The second end 402 of the extension spring 400 may be connected to the bottom wall 104 of the housing 100. The lock cage 500 is provided to allow the fastener 10 to be locked with the connector 30 in the secured position in the housing 100, so as to prevent accidental detachment of the connector 30 from the housing 100. The locking mechanism of the lock cage 500 will be described in greater detail below.

In general, the lock cage 500 may comprise a top panel 502 orthogonally attached to a top end of a back panel 501 of the lock cage 500. The first end 401 of the extension spring 400 is preferably attached to the back panel 501 of the lock cage. Within the lock cage 500, in a space defined by the top panel 502 and the back panel 501, the portion of the securing pin 140 is positioned in continuous contact with at least the top panel 502 of the lock cage 500, as can be seen in the section views A-A, B-B and C-C of FIGS. 4(*a*) to 4(*c*) respectively. Whenever the securing pin 140 is raised, the securing pin 140 pushes upwardly against the top panel 502 of the lock cage 500, thereby raising the lock cage 500 together with the securing pin 140. Raising the lock cage 500 extends the extension spring 400, as shown in FIG. 4(*b*). Downward bias is permanently applied by the extension spring 400 onto the lock cage 500 which in turn applies the downward bias onto the securing pin 140 via the top panel 502 of the lock cage.

The extension spring 400 thus provides the permanently applied downward bias acting on the securing pin 140. An external force is required to extend the spring 400 (shown extended in FIG. 4(*b*)) in order to raise the securing pin 140 together with the lock cage 500 in the housing 100 whenever the connector 30 is being inserted into the housing 100 or removed from the housing 100.

In the absence of any external force applied to the securing pin 140, the extension spring 400 keeps the securing pin 140 in its disengaged position shown in FIGS. 1(*a*) and 4(*c*). The main body 20 may be provided with at least one pin support 141 in the housing 100 positioned below at least one end of the securing pin 140 that extends within the housing 100 beyond the slot 130, away from the vertical translation path of the lock cage 500 as shown in FIGS. 4(*a*) to 4(*c*). In this way, when in the disengaged position, the at least one end of the securing pin 140 rests against the at least one pin support 141, under action of the downward bias permanently applied by the extension spring 400 on the securing pin 140 via the top panel 502 of lock cage 500, so that the lower portion of the securing pin 140 partially obstructs the upper portion of the slot 130.

The lock cage 500 may optionally have a bottom panel 503 orthogonally attached to a bottom end of the back panel 501, for added positioning accuracy of the lock cage 500 within the housing 100. For example, the bottom panel 503 may have a sliding fit with the front wall 120 of the housing 100 when the lock cage 500 is assembled with the housing 100. Additionally, the bottom panel 503 may also come into contact with the bottom wall 104 of the housing 100 when the central portion 203 of the connector 30 is in the secured position in the main body 20, under the downwardly biased securing pin 140 (Section A-A of FIG. 4(*a*)), and/or when the securing pin 140 is in the disengaged position (Section A-A of FIG. 4(*c*)).

Figure 5:
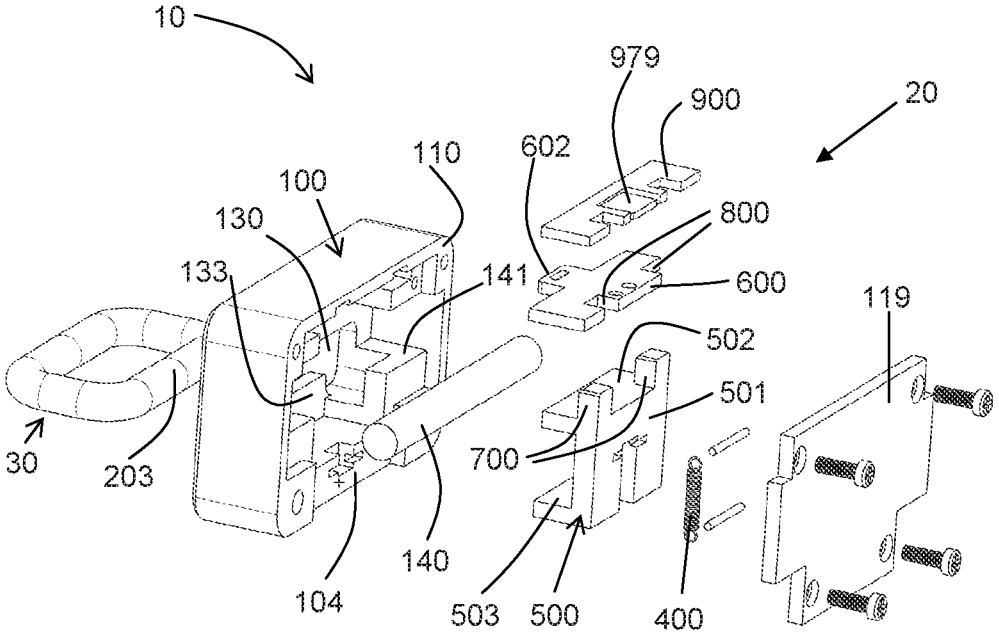
FIG. 5 is an exploded assembly view of the first exemplary embodiment of the fastener.
Figure 6A:
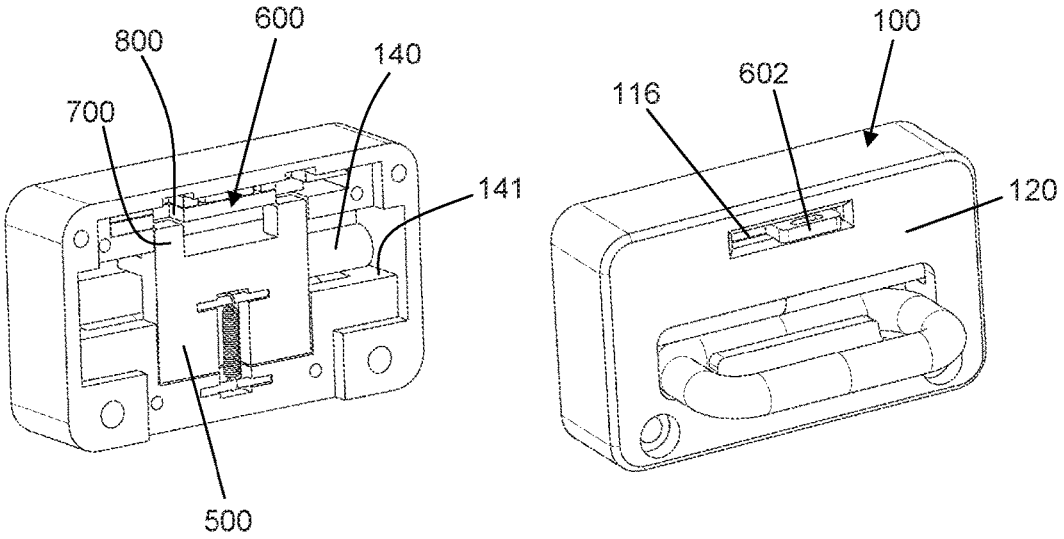
FIG. 6(*a*) shows front and back isometric views of the first exemplary embodiment of the fastener in an unlocked position.
Figure 6B:
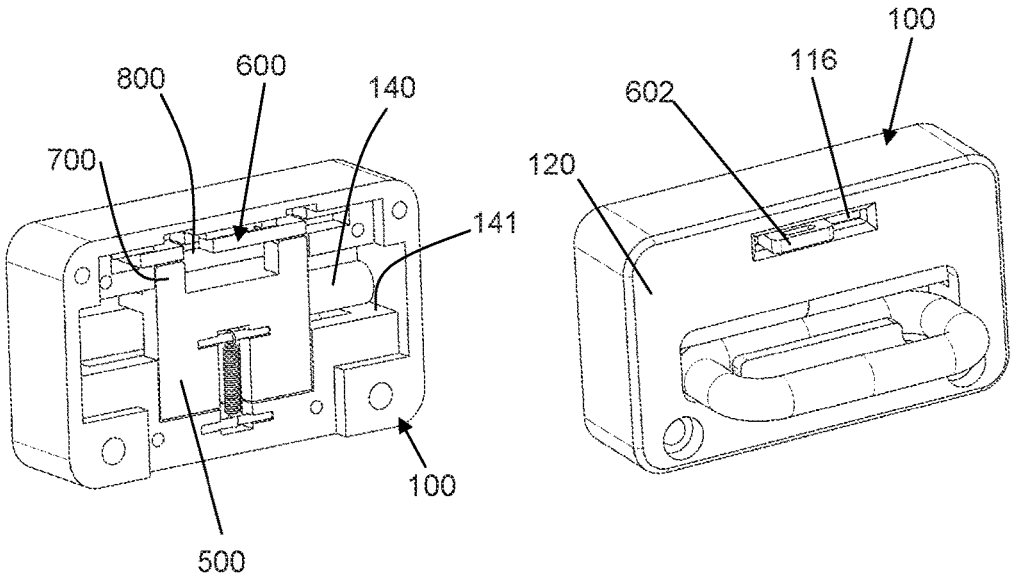
Figure 10:
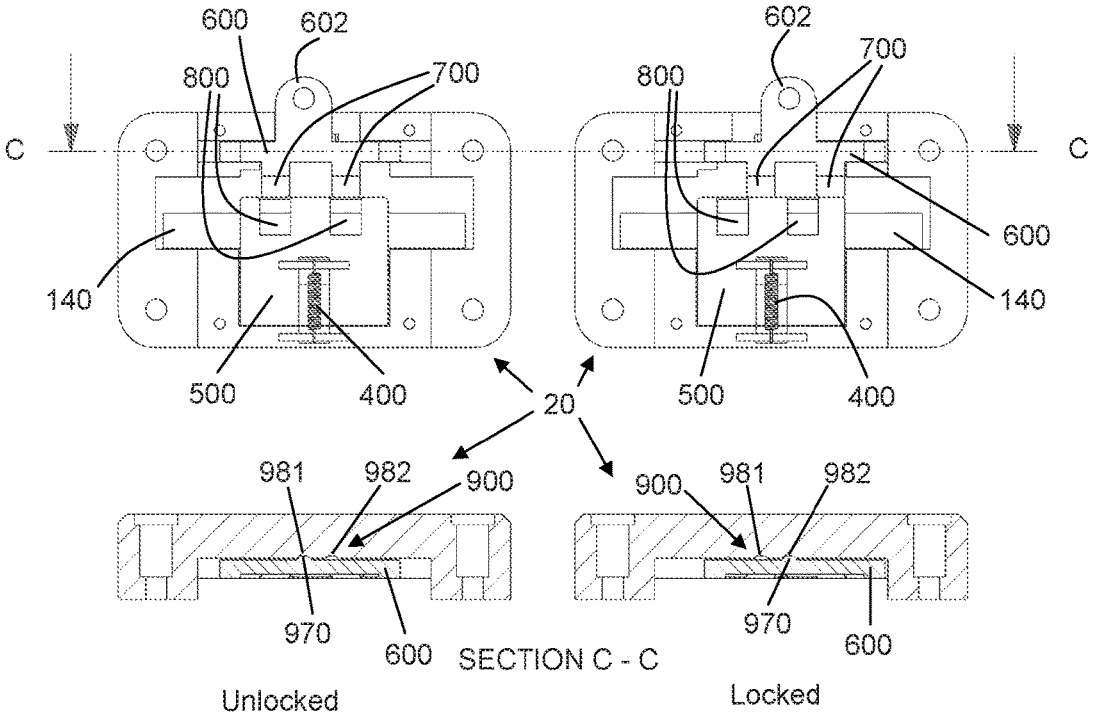
FIG. 10 shows back and cross-sectional top views of a second exemplary embodiment of the fastener in an unlocked position and a locked position.

To prevent accidental detachment of the connector 30 from the main body 20, the lock cage 500 is configured to be preventable from upward translation within the housing 100 by providing a lock bar 600 in the main body 20, above the lock cage 500 in the housing 100, as shown in FIGS. 5 to 6(*b*) and FIG. 10. The lock bar 600 is configured to be translatable between an unlocked position (FIGS. 6(*a*) and 10—unlocked) and a locked position (FIGS. 6(*b*) and 10—locked). In the locked position, the lock bar 600 obstructs and prevents upward translation of the lock cage 500 to prevent upward movement of the securing pin 140, thereby preventing upward movement of the central portion 203 of the connector 30 from the secured position to the release position in which the connector 30 can exit the housing 100.

The lock bar 600 may be provided adjacent the lock cage 500, and at least one stub 700 may be provided on one of the lock cage 500 and the lock bar 600, and a corresponding at least one cut-out 800 may be provided on the other of the lock cage 500 and the lock bar 600, the cut-out 800 being able to accommodate the stub 700 therein. The stub 700 and the cut-out 800 are configured and provided on the lock cage 500 and the lock bar 600 such that in the unlocked position, the stub 700 and the cut-out 800 are vertically aligned (FIGS. 6(*a*) and 10—Unlocked) to allow relative movement of the stub 700 into the cut-out 800 to allow upward translation of the lock cage 500. When the stub 700 and the cut-out 800 are not vertically aligned (FIGS. 6(*b*) and 10—Locked), the lock bar 600 obstructs upward translation of the lock cage 500. In this way, the fastener 10 may be locked to prevent removal of the connector 30 from the main body 20.

Vertical alignment of the stub 700 and the cut-out 800 are effected by appropriate horizontal positioning of the lock bar 600. To that end, the lock bar 600 may comprise a tab 602 configured to extend out of the housing 100 for the user to selectably translate the lock bar 600 horizontally between the locked position and the unlocked position. Accordingly, the housing 100 is provided with a tab opening 116 configured to allow extension of the tab 602 through the tab opening 116 and horizontal movement of the tab 602 within the tab opening 116. A through hole may be provided in the tab 602 to allow the user to attach a cord (not shown) such as a lanyard to the tab 602, for more convenient activation of the lock by the user pulling on the cord to horizontally translate the lock bar 600 between the locked position and the unlocked position.

In the first embodiment of the fastener 10 shown in FIGS. 1(*a*) to 6(*b*), the at least one stub 700 is provided on the lock cage 500 and the at least one cut-out 800 is provided on the lock bar 600. The two stubs 700 shown in this embodiment are contiguous with the back panel 503 of the lock cage 500 and extend upwardly beyond the top panel 502 of the lock cage 500. The stubs 700 and the cut-outs 800 can be seen to be vertically aligned in the back views of the main body 20 in FIGS. 4(*a*) to 4(*c*), thereby allowing upward translation of the lock cage 500 to allow the securing pin 140 to be raised, and thereby allowing the connector 30 to be inserted into or removed from the main body 20. In the first embodiment, the tab opening 116 is provided in the front wall 120 of the housing 100 and the tab 602 is located on a front surface of the lock bar 600 and extends out of the front wall 120 of the housing 100.

Figure 9:
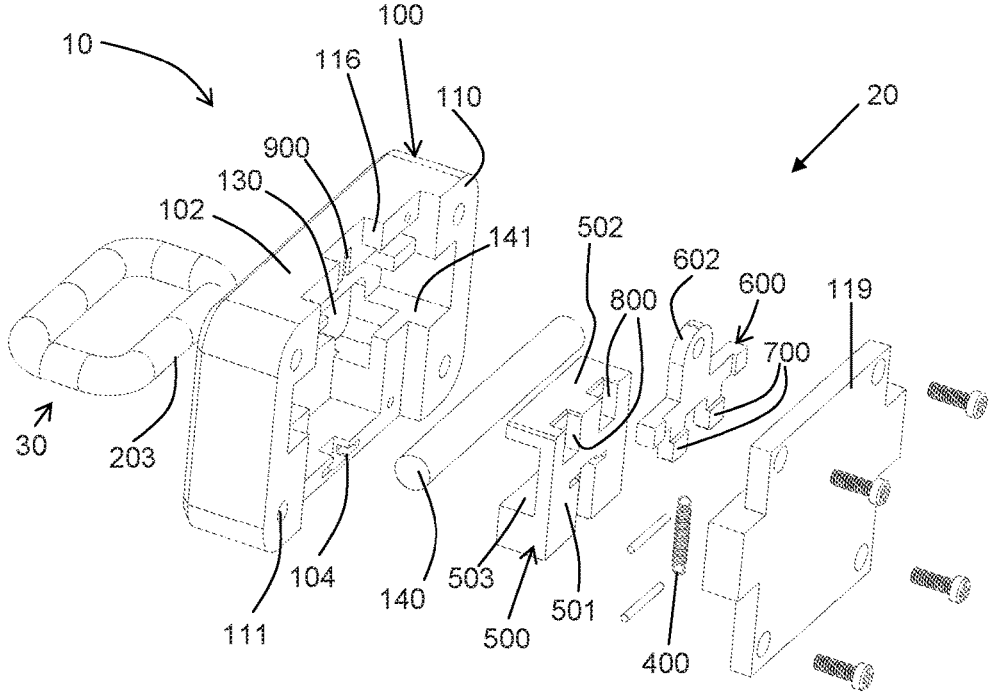
FIG. 9 is an exploded assembly view of a second exemplary embodiment of the fastener.
Figure 11:
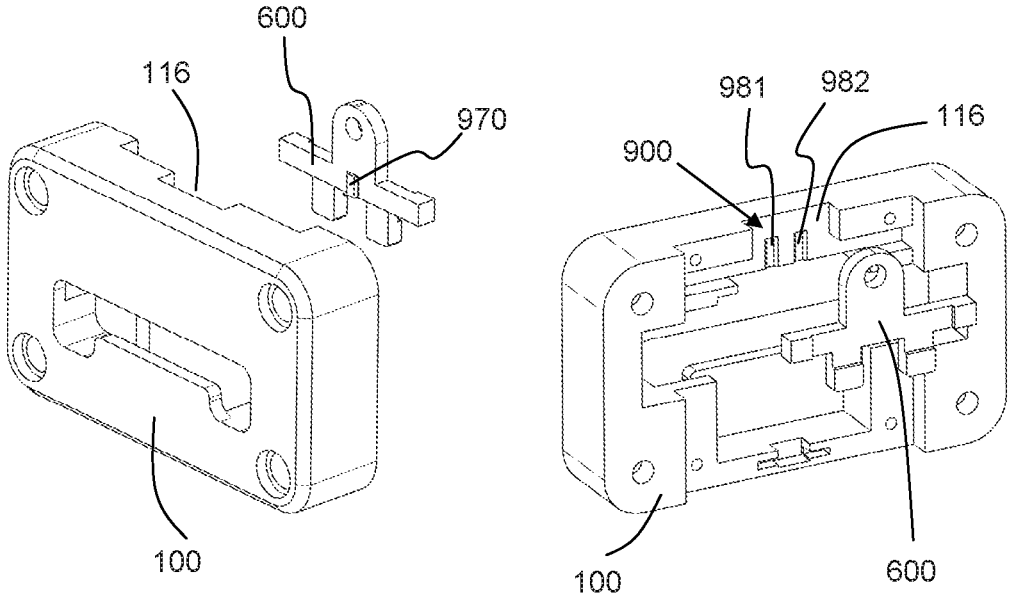
FIG. 11 shows front and rear exploded assembly views of the lock positioner and the housing of the second exemplary embodiment.

In a second embodiment of the fastener 10 shown in FIGS. 9 to 11, the at least one stub 700 is provided on the lock bar 600, and the at least one cut-out 800 is provided on the lock cage 500. In this embodiment, the two stubs 700 shown extending downwardly from the lock bar 600 towards the lock cage 500, and two cut-outs 800 shown extend downwardly from the top panel 502 into the back panel 503 of the lock cage 500. The stubs 700 and the cut-outs 800 can be seen to be vertically aligned in the unlocked back view of the main body 20 in FIG. 10 (a back plate 119 forming at least part of the back wall 110 of the housing 100 is hidden from view in this figure, for clarity of the internal components), thereby allowing upward translation of the lock cage 500 to allow the securing pin 140 to be raised, and thereby allowing the connector 30 to be inserted into or removed from the main body 20. In the locked back view of the main body 20 in FIG. 10, the stub 700 and cut-out 800 are not aligned so that the lock bar 600 obstructs upward translation of the lock cage 600 to prevent the securing pin 140 from being raised. In the second embodiment, the tab opening 116 is provided in the top wall 102 of the housing 100 and the tab 602 is located on a top surface of the lock bar 600 and extends out of the top wall 102 of the housing 100.

To keep the lock bar 600 in either the locked position or the unlocked position, a lock positioner 900 is provided in the main body 20 to engage the lock bar 600 in the unlocked position and in the locked position. The lock positioner 900 is fixed relative to the housing 100. A bump 970 is provided on one of the lock positioner and the lock bar 600 while two spaced-apart indentations 981, 982 are provided on the other of the lock positioner and the lock bar 600. The bump 970 and two indentations 981, 982 are configured such that when the bump 970 is received in the first indentation 981, the lock bar 600 is in the unlocked position, and when the bump 970 is received in the second indentation 982, the lock bar 600 is in the locked position. Relative movement of the bump 970 between the first indentation 981 and the second indentation 982 requires application of a force on the lock bar 600 to disengage the bump 970 from whichever indentation 981 or 982 that the bump 970 is currently received in. In use, the lock bar 600 is moved horizontally to align either the first indentation 981 or the second indentation 982 with the bump 970. In this way, accurate positioning of the lock bar 600 in the unlock and locked positions may be achieved by appropriate movement of the lock bar 600 relative to the lock positioner 900, while also minimizing accidental unlocking of the fastener 10 when in the locked position.

Figure 7:
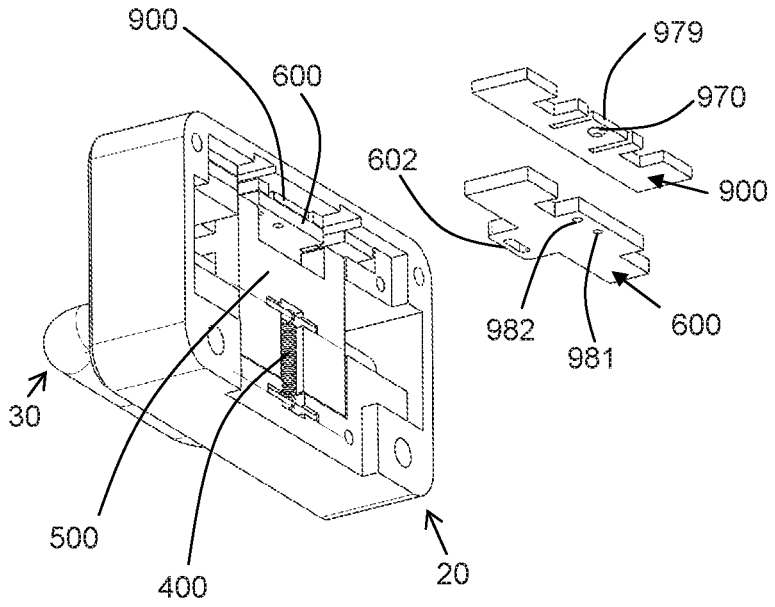
FIG. 7 is a bottom perspective back view of a lock positioner of the first exemplary embodiment with the lock bar and lock positioner shown again in an exploded assembly view.
Figure 8:
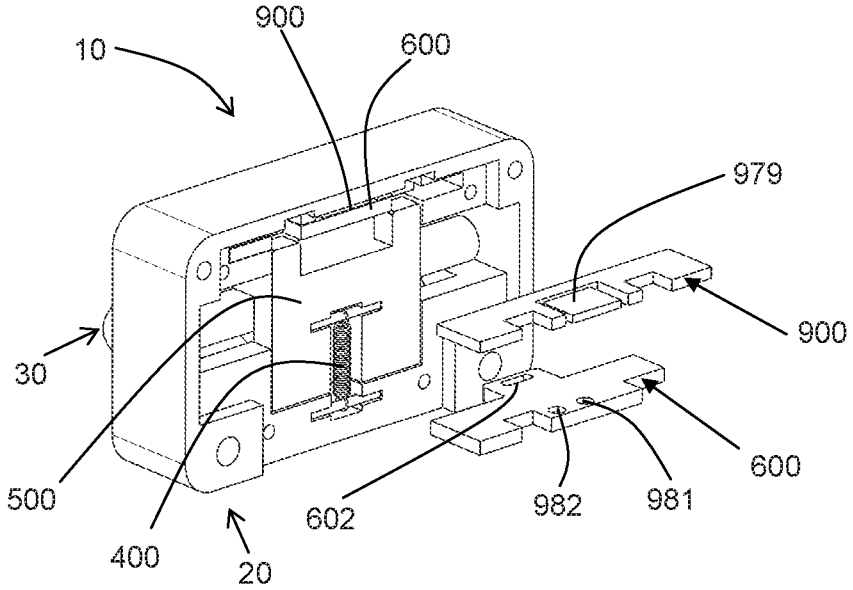
FIG. 8 is a top perspective back view of the lock positioner of the first exemplary embodiment with the lock bar and lock positioner shown again in an exploded assembly view.

In the first embodiment of the fastener 10 as shown in FIG. 7, the lock positioner 900 comprises the bump 970 provided on a lower surface of a horizontally positioned bar provided above the lock bar 600 in the housing 100. The bump 970 is provided preferably on a cantilevered beam 979 provided in the lock positioner 900. The two indentations 981, 982 are provided on an upper surface of the lock bar 600 and are each configured to receive the bump 970 therein. The two indentations 981, 982 may be provided as countersunk through holes in the lock bar 600, as can be seen from FIGS. 7 and 8. In the first embodiment, the bump 970 remains stationary while the indentations 981, 982 on the lock bar 600 move with the lock bar 600 to change their alignment with the bump 970.

Referring to FIGS. 10 and 11 (a back plate 119 forming at least part of the back wall 110 of the housing 100 is hidden from view in these figures, for clarity of the internal components), the lock positioner 900 in the second embodiment of the fastener 10 comprises the two spaced-apart indentations 981, 982 provided on a back-facing wall of the tab opening 116. The bump 970 is provided on a front-facing wall of the lock bar 600. In the second embodiment, the indentations 981, 982 remain stationary while the bump 970 on the lock bar 600 moves with the lock bar 600 between the two indentations 981, 982.

From the above description, it will be appreciated that not only is the fastener 10 easy to use in terms of securing and detaching the connector 30 to and from the main body 20, the fastener 10 may also be easily locked to prevent accidental detachment of the connector 30 from the main body 20. In the main body 20, the lock cage 500 provides a first function of providing an attaching point for the first end of the extension spring 400, a second function of positioning the securing pin 140 within the housing and transmitting the downward bias from the extension spring 400 to the securing pin 140, and a third function of locking the fastener 10 when obstructed from upward translation by the lock bar 600 in the locked position.

Whilst there has been described in the foregoing description exemplary embodiments of the present invention, it will be understood by those skilled in the technology concerned that many variations and combinations in details of design, construction and/or operation may be made without departing from the present invention. For example, in the first embodiment, the bump may alternatively be provided on the lock bar and the two indentations may alternatively be provided on the lock positioner. In the first embodiment, the at least one cut-out may alternatively be provided on the lock cage and the at least one stub may alternatively be provided on the lock bar. In the second embodiment, the bump may alternatively be provided on the back-facing wall of the tab opening and the two indentations may alternatively be provided on the lock bar. In the second embodiment, the at least one cut-out may alternatively be provided on the lock bar and the at least one stub may alternatively be provided on the lock cage. More than one extension spring may be provided to permanently apply the downward bias on the securing pin. Instead of an extension spring, at least one compression spring may be provided and appropriately positioned to permanently apply the downward bias on the securing pin. Where a compression spring is used, a first end of the compression spring may be in functional connection with the securing pin while a second end of the compression spring may be attached to the top wall of the housing. Instead of the lock bar provided adjacent and above the lock cage as depicted in the figures and described above, the lock bar may be provided in the housing above the lock cage such that in the unlocked position, the lock bar is positioned at a distance above the lock cage to allow upward translation of the lock cage and the securing pin for removal of the connector, and in the locked position, the lock bar is positioned adjacent the lock cage to obstruct and prevent upward translation of the lock cage.

The invention claimed is:

1. A fastener for detachably securing a first item to a second item, the fastener comprising:

a connector comprising a U-shaped rod having a central portion between two legs, the connector configured to be attached to the first item; and a main body configured to be attached to the second item, the main body comprising a housing having a slot configured to allow passage of the central portion therethrough into the housing, the slot having an upstanding lip provided at a lower edge of the slot, the upstanding lip defining two downwardly extending openings, each of the two downwardly extending openings at each end of the slot and configured to allow each of the two legs to extend out of the housing when the central portion is in a secured position where the central portion is lowered in the housing relative to the slot and engages an inner surface of the upstanding lip; and a downwardly biased securing pin provided within the housing, the securing pin exerting a downward bias against the central portion in the secured position.

2. The fastener of claim 1, further comprising a vertically translatable lock cage provided in the housing, a portion of the securing pin positioned within the lock cage, the lock cage transmitting the downward bias against the portion of the securing pin, and a lock bar provided in the housing above the lock cage, the lock bar translatable between an unlocked position and a locked position, in the unlocked position the lock bar allowing upward translation of the lock cage thereby allowing upward movement of the securing pin, and in the locked position the lock bar obstructing and preventing upward translation of the lock cage thereby preventing upward movement of the securing pin.

3. The fastener of claim 2, wherein the lock bar is provided adjacent the lock cage, at least one stub is provided on one of the lock cage and the lock bar, and at least one cut-out is provided on the other of the lock cage and the lock bar, the at least one cut-out able to accommodate the at least one stub therein, wherein in the unlocked position, the at least one stub is vertically aligned with the at least one cut-out to allow relative movement of the at least one stub into the at least one cut-out to allow upward translation of the lock cage, and wherein in the locked position, the at least one stub and the at least one cut-out are not vertically aligned.

4. The fastener of claim 2, further comprising a lock positioner configured to engage the lock bar in the unlocked position and in the locked position, wherein a bump is provided on one of the lock positioner and the lock bar, and wherein two spaced-apart indentations are provided on the other of the lock positioner and the lock bar, the bump received in one of the two indentations in the unlocked position and the bump received in the other of the two indentations in the unlocked position.

5. The fastener of claim 1, wherein the securing pin comprises a cylindrical rod free to rotate about its central longitudinal axis.

6. The fastener of claim 1, wherein the central portion of the U-shaped rod comprises a cylindrical rod.

7. The fastener of claim 1, wherein the downward bias is provided by an extension spring provided in the housing.

* * * * *